United States Patent [19]

List

[11] Patent Number: 4,483,253

[45] Date of Patent: Nov. 20, 1984

[54] FLEXIBLE RAILWAY CAR TRUCK

[76] Inventor: Harold A. List, 38 W. University Ave., Bethlehem, Pa. 18015

[21] Appl. No.: 348,922

[22] Filed: Feb. 16, 1982

[51] Int. Cl.[3] ..... B61F 3/08; B61F 5/30; B61F 5/38

[52] U.S. Cl. ..... 105/167; 105/168; 105/208; 105/223; 105/224.1

[58] Field of Search ..... 105/168, 208, 224.1, 105/222, 223, 167; 29/401.1

[56] References Cited

U.S. PATENT DOCUMENTS

| | | | |
|---|---|---|---|
| 2,044,971 | 6/1966 | Clasen | 105/208 |
| 3,380,400 | 4/1968 | Barber | 105/223 X |
| 3,381,629 | 5/1968 | Jones | 105/224.1 X |
| 3,638,582 | 2/1972 | Beebe | 105/224.1 |
| 3,670,660 | 6/1972 | Weber | 105/208 X |
| 3,844,226 | 10/1974 | Brodeur et al. | 105/224.1 |
| 4,131,069 | 12/1978 | List | 105/168 |
| 4,363,278 | 12/1982 | Mulcahy | 105/224.1 |

OTHER PUBLICATIONS

Performance Analysis and Testing of a Conventional Three-Piece Freight Car Truck Retrofitted to Provide Axle Steering, Marcotte, P; Caldwell, W. N.; List, H. A.; Journal of Dynamic Systems, Measurement, and Control; Mar. 1982; vol. 104; pp. 93-99 inclusive.

*Primary Examiner*—Howard Beltran

*Attorney, Agent, or Firm*—Kenneth P. Synnestvedt

[57] ABSTRACT

A multiple axle railway truck having side frames with pedestals, roller bearings for the axles received in the pedestal jaws with clearance in a direction fore-and-aft of the vehicle to permit relative yawing motion of the axles. A yielding pad is provided between the bearing and the base of each pedestal jaw, and a transverse plank extends between the side frames to restrain fore-and-aft motion of the side frames and is torsionally flexible thereby permitting relative angular motion of the side frames in vertical planes.

4 Claims, 6 Drawing Figures

FLEXIBLE RAILWAY CAR TRUCK

BACKGROUND OF THE INVENTION

The axles of most railway trucks now in use are rigidly constrained, as viewed in plan, to remain parallel in curves as well as on straight track. In view of this, the self-steering properties which are known to exist in and which are inherent in rotating axle wheelsets are prevented from producing a radial axle position in curves, but the wheelsets are not prevented from synchronously oversteering on straight track. In curves, the presence of the resulting large angle of attack between the wheel and the rail causes wear of both the wheel and the rail. The energy dissipated in the wear process causes extra rolling resistance, as well as roughness and attendant noise.

The excess steering motion on straight track can become large enough to cause severe lateral oscillation of the truck parts and the car body at high speed. This lack of steering stability is accompanied by wear of truck parts, loosening of track fastenings, and fatigue failures of car body structure.

The problems of both high-speed stability and curving are effectively solved by truck constructions described in my prior U.S. Pat. No. 4,131,069, issued Dec. 26, 1978, and also in my copending application Ser. No. 948,878, filed Oct. 5, 1978, and have been established by extensive field testing. However, the cost of applying the measures taught by the '069 patent and by application Ser. No. 948,878, may in some cases, restrict this solution to cars in high-mileage service. Accordingly, it would be advantageous to have a less expensive method to reduce the hunting and curving problems of trucks, even if the improved results are not quite as extensive as can be obtained with the constructions shown in the '069 patent, and in said pending application.

It has also been known to use a transverse spring plank in a three-piece freight car truck spanning the two side frames and located between the springs and the side frames. Although these spring planks tend to restrain the parallel yaw motion of the axles and bolster and thereby contribute to high-speed stability, use of such spring planks was generally discontinued in trucks some years ago, in part because the planks were subject to cracking, and in part because the trucks were equipped with plain journal bearings rather than roller bearings; and in such trucks with plain bearings, the stability problem is not severe, in view of which the advantage of using the spring plank is not as great with the plain bearings as it is with roller bearings. However, there is one current roller bearing "premium" truck design, i.e., the National "Swing Motion" truck which uses a spring plank. From field tests of this truck, I have found that, with the roller bearings employed in that truck, the spring plank is a beneficial and low cost way of reducing truck hunting. However, that truck is not in wide use, partly because it is expensive and partly because it does not solve the angle of attack problem in curves.

SUMMARY OF THE INVENTION

The widely used conventional three-piece AAR truck is a roller bearing truck; and it is the principal objective of my present invention to provide a simple, low cost method of and apparatus for modifying, that is "retrofitting", this existing three-piece roller bearing truck in such a way as to improve both its high-speed stability and the angle of attack in curves. This method consists of two basic steps: (1) interconnection of the two side frames by means of a plank; and (2) introduction of flexibility between the roller bearing adapters and the side frames. This flexibility is achieved by the introduction of yieldable motion restraining means, preferably elastomeric in nature, between said bearing adapters and the side frames. In one embodiment, it is also contemplated to introduce additional clearance for axle/side frame motions in the longitudinal and lateral directions.

The plank prevents fore-and-aft motion of the two side frames relative to each other in plan view, and desirably, the plank or plank means employed is designed to have some torsional flexibility, so that it does not become overstressed when the side frames pitch relative to each other on rough track.

The mentioned flexibility between the roller bearing adapters and the side frames allows the axles to yaw relative to each other.

In another aspect of my invention, it is an objective to provide such a truck, including both spring plank and resilient means.

The basic theoretical approach to choosing the amount of restraint on the above inter-axle motions is summarized in a technical paper by Marcotte, Caldwell, and List which was presented to the Winter Annual Meeting of the American Society of Mechanical Engineers in 1978. This paper defines two restraint parameters, the "Stiffness Ratio, R" and the "Normalized Yaw Stiffness", and describes how these parameters affect truck stability and curving. Whether a truck designer wishes to emphasize improved curving or high-speed stability, he will find values near or below 1 to be the most attractive for either "R" or "Yaw Stiffness". It should be understood that with the more refined construction shown in the '069 patent, which includes steering arms, the designer may choose a value for R below 1. However, if he chooses the approach of the present invention, the detail design of the individual resilient elements in the truck is more limited, being restricted to values greater than 1. With the truck construction taught herein, the stiffness ratio "R" will ordinarily be between about 1 and 2. Any value can be chosen for the yaw stiffness, and the design of the resilient parts remains simple and may be as taught in my earlier disclosures. While the parameters available with the apparatus described and claimed herein do not achieve results as good as those achieved with the steering arm construction of my prior patent and application above identified, they are far more attractive than those of the conventional truck, for which the stiffness ratio "R" is more than 10, with a similarly undesirable value for the "Yaw" stiffness.

DESCRIPTION OF THE PRIOR ART

Figure 1:
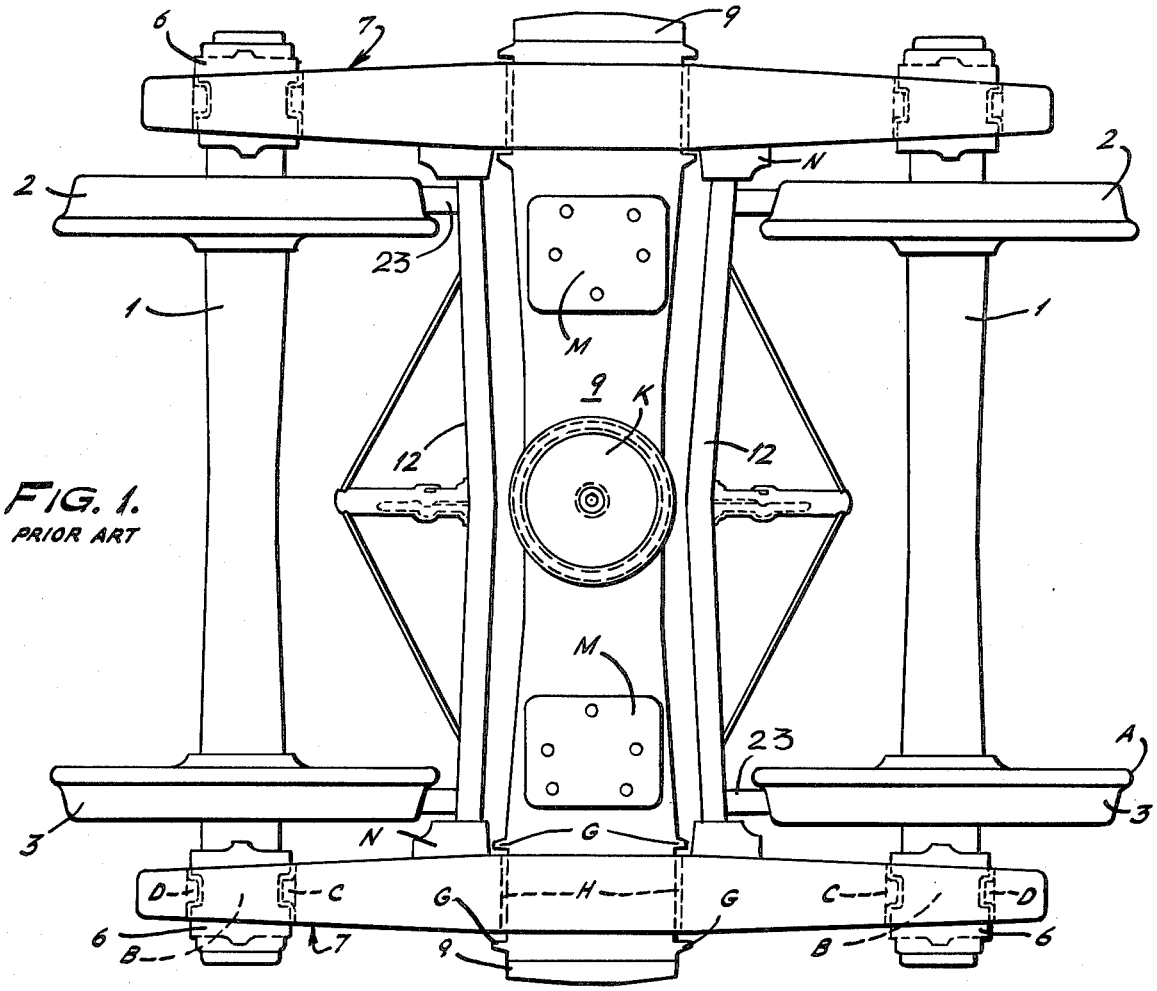
FIG. 1. PRIOR ART
FIG. 1 is a plan view of the existing, conventional, AAR roller bearing three-piece freight car truck, shown prior to the retrofitting contemplated in accordance with the present invention.
Figure 2:
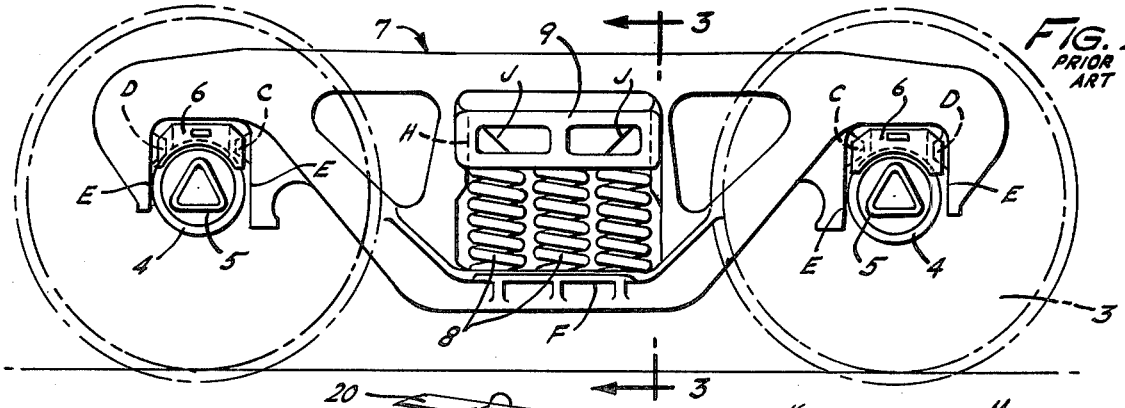
FIG. 2. PRIOR ART
FIG. 2 is an elevational view of the same truck.
Figure 3:
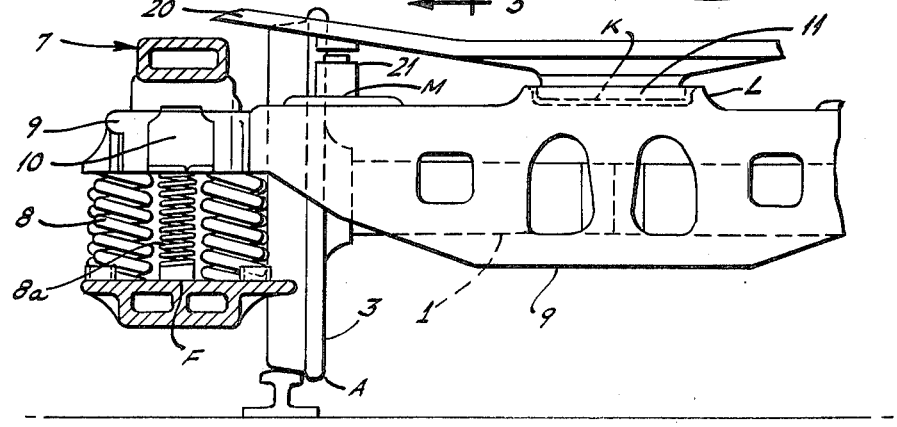
FIG. 3. PRIOR ART
FIG. 3 is a section through the spring group taken on line 3—3 of FIG. 2.

The conventional three-piece freight car truck shown in FIGS. 1-3 has two rotating axles 1 with pressed-on wheels 2 and 3 having conventional tread profiles which provide a larger than average rolling radius when the wheel/rail contact is near the flange A and a smaller rolling radius as the contact point moves away from the flange. Such a wheelset, when displaced laterally on the track, will tend to steer toward the track centerline under the influence of the difference in the rolling radii of wheel 2 compared with wheel 3.

Roller bearings 4 are pressed on the axles and retained by end caps 5. Vertical, longitudinal, and lateral loads are applied to the bearings through adapters 6. Vertical load is applied to each adapter by the side frame 7 at locations B (FIG. 1). Longitudinal and lateral loads are applied through frictional contact between adapters and side frames at locations B, with backup by contact at the interlocking side frames and adapters, which are shaped as shown at C and D. Longitudinal loads may also be exchanged directly between the bearings 4 and the side frames 7, at locations E.

The springs 8 are supported by the side frames in the regions F. The springs apply vertical, lateral and yaw forces to the side frames through the spring-carried bolster 9, which receives the vertical, lateral and yaw forces. Longitudinal loads are exchanged directly between the bolster and the side frames in the regions H. There is also some vertical, lateral and yaw force exchanged between the bolster and the side frames through the wedges 10 (FIG. 3) mounted in bolster pockets J and bearing on the side frame in the region H. Large lateral and yaw loads are exchanged by contact of the side frame with the bolster lugs shown at G (FIG. 1).

Under most conditions, the vertical load of the car body 20 is applied to the bolster 9, at K, through a center plate 11 formed on the car body. Lateral and longitudinal loads are applied to the bolster initially by friction at K (FIGS. 1 and 3) and then by contact of the car center plate with the rim of the center plate bowl L which is circular to accommodate truck swivel. Friction between the center plate and the bolster at K tends to restrain truck swivel, and also smaller yaw motions of the bolster and the axles on straight track. Roll motion of the car body is controlled to a limited extent by the relatively large diameter of the contact surface K. However, it is usual and desirable to mount side bearings 21 on the bolster at M to prevent large roll motion of the car body relative to the bolster.

FIG. 1 shows conventional brake beams 12 mounted to the side frames in slots N. However, other known brake equipment, such as brake beams incorporating brake cylinders, can be used. Looking at FIG. 1, it can be visualized that when one axle moves laterally with respect to the other and the side frames move out of square, the brake beam can be driven laterally into the slot N. Therefore, clearance must be provided for this motion. This means that the brake beams can not be precisely guided laterally with respect to the wheelsets. As a result, the brake shoes can be displaced laterally on the wheel treads, often causing flange wear. As shown below, the apparatus of the present invention substantially overcomes these difficulties.

DESCRIPTION OF THE PREFERRED PRACTICE OF THE INVENTION AND OF THE RESULTANT IMPROVED APPARATUS

The primary feature of the present invention is the provision of a novel and very simple technique for retrofitting existing trucks to provide for steering of the wheelsets. The invention may readily be applied to any present roller bearing, freight truck of the Association of American Railroads design, of the kind mentioned above and shown in the drawings. The invention teaches retrofitting of the AAR truck by the provision of a transverse plank in the truck, combined with the use of resilient pads disposed to react between the axles and the side frames. Desirably, this structure comprises elastomeric pads reacting between the axle bearing adapters and the pedestal areas of the side frames. Such pads, when stressed in shear, allow steering motions of the axles and develop a restoring force which tends to return the axles toward parallelism.

The retrofitting method is briefly described as follows.

An existing truck is selected having load-carrying side frames spanning two rotatable, roller bearing, axle wheelsets. The side frames are of the kind presenting laterally opposed pairs of pedestal areas or jaws within which are received the bearing adapters of the axle roller bearings, with the adapters in load-bearing relation with the pedestal areas of the side frames. The truck is further of the type which has a transverse bolster supported by the side frames through conventional springs and damping devices.

In accordance with the retrofitting technique, when the selected truck does not already include a spring plank, a transverse plank is installed directly beneath and in parallelism with the bolster and spaced therefrom. The ends of the plank are connected with the truck frames; and for this purpose, the ends of the plank may be interposed between the truck springs and the side frames. The plank inserted may comprise a structural beam or plank resembling spring planks previously employed in some trucks as above mentioned. However, other forms of structural beams or planks may be used as will be explained. As mentioned below, the shape and structure of the spring plank is selected to restrain relative fore-and-aft motion between the two side frames, as viewed in plan, without preventing relative pitching motions of the side frames.

The method also includes introduction of yieldable motion restraining structure, for example, elastomeric pads, between the axle bearing adapters and the side frames, preferably at both of the two wheelsets.

In the case of a truck having roller bearings and already having a spring plank, the elastomer pads above referred to are introduced at at least one of the wheelsets.

Figure 4:
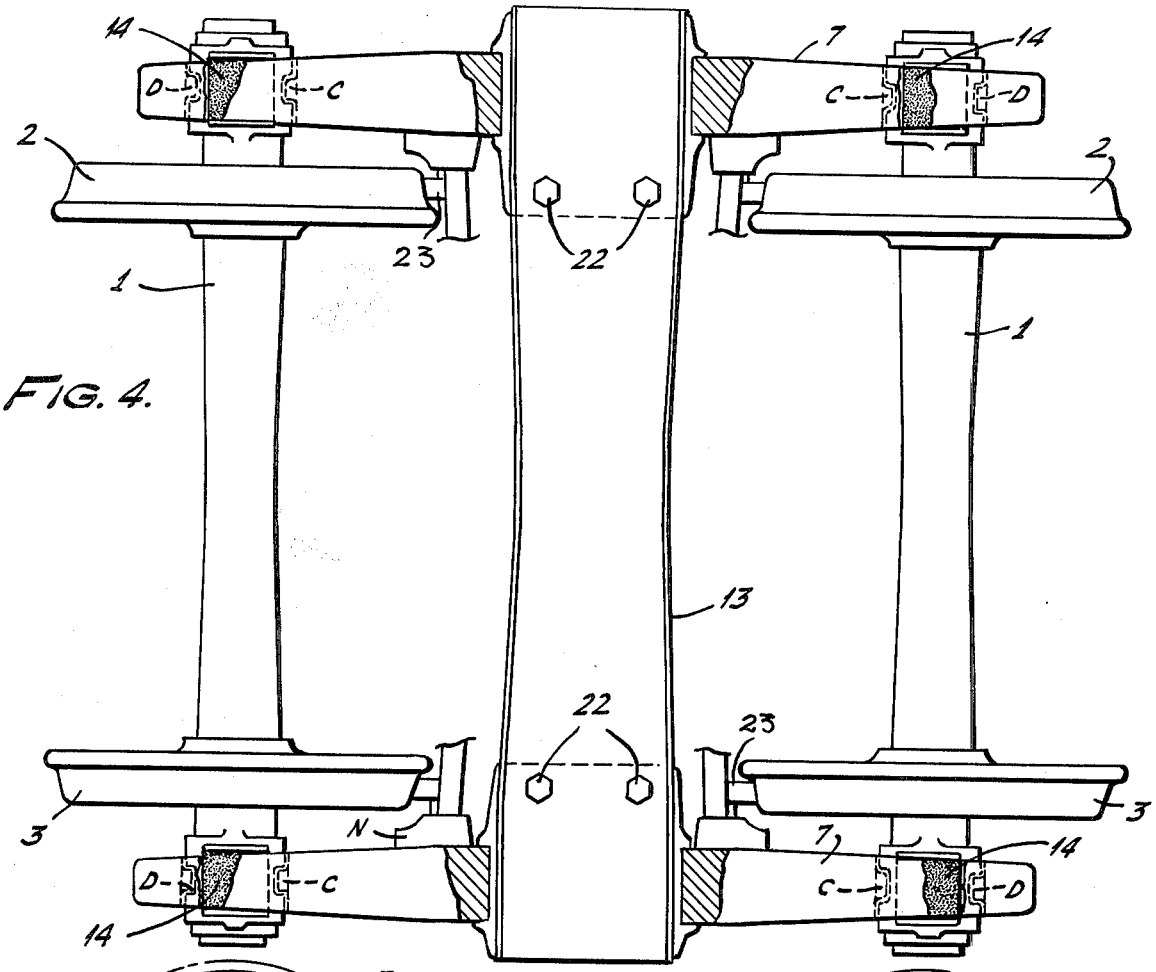
FIG. 4 is a plan view of the truck of FIG. 1 to which a spring plank, and resilient side frame/bearing adapter pads have been added, thereby bringing the truck into accordance with this invention.
Figure 5:
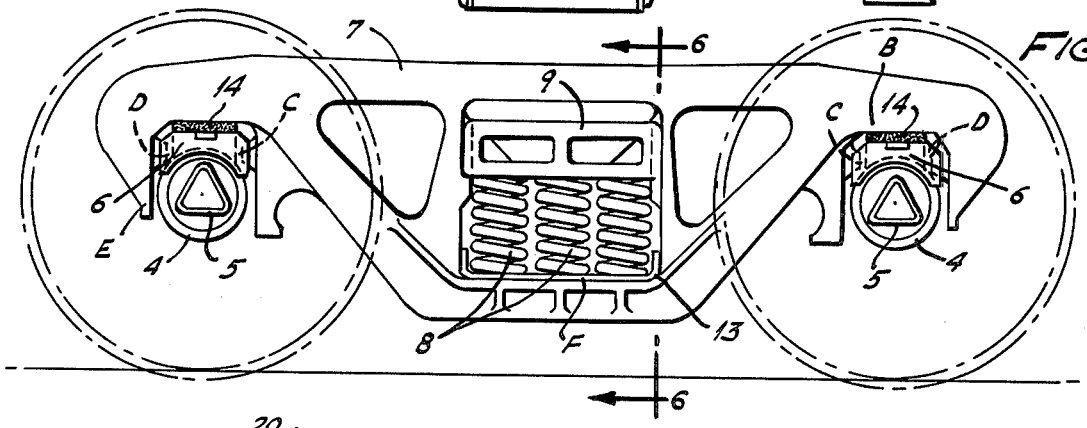
FIG. 5 is an elevation of the truck in FIG. 4 and shows the open channel shape of the spring plank.
Figure 6:
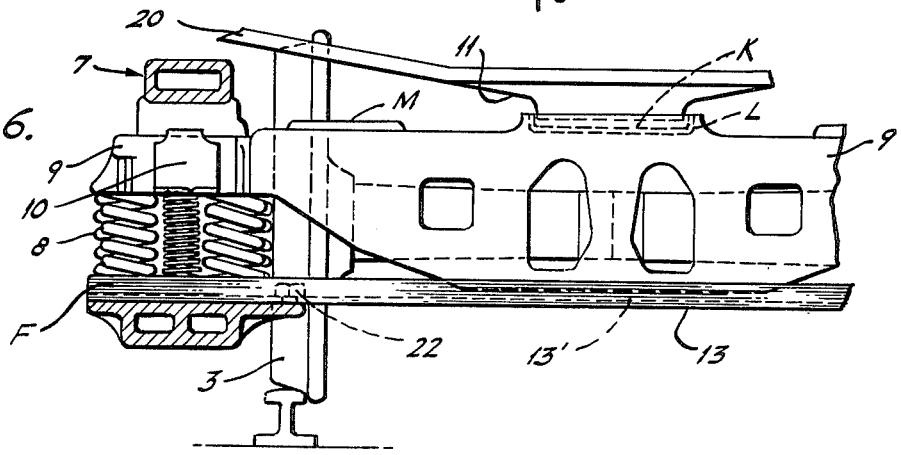
FIG. 6 is a sectional view of the truck, the view being taken along the line 6—6 of FIG. 5.

Now with detailed reference to FIGS. 4, 5 and 6 of the drawings, it should be noted that these figures show the same basic structure as illustrated in FIGS. 1 to 3. To simplify the presentation, parts of the structure shown in FIGS. 4 to 6, which are similar to parts appearing in FIGS. 1 to 3, are identified with similar reference characters.

The plank inserted in the truck is shown at 13, and its channel shape will be understood by comparison of FIGS. 4, 5 and 6. The plank 13 restrains the side frames 7 from moving relative to one another in plan view, since the weight of the car clamps the end portions of the plank between the springs 8 and the side frames, in the region F. It is important that the plank 13 remains out of contact with the overlying bolster 9. A gap is shown at 13' in FIG. 6 and should be of such dimension as to be maintained, even when the car is loaded. The plank can also be designed to interlock with the spring location lugs usually cast on the side frame in region F. The plank has torsional flexibility such as to permit relative pitching motion of one side frame relative to the other. To maximize this flexibility, the plank desirably has an open channel-shaped cross section, as shown in FIG. 5. The stresses associated with the twist can be reduced, if desired, by providing cutouts (not shown) in the broad flat bottom portion between the side frames.

With the two side frames 7 interconnected by the plank substantially to prevent relative motion in plan view, the shear stiffness of the elastomeric pads 14, added between the adapters 6 and the side frames, at pedestal locations B, is effective in restraining inter-axle lateral and yaw motions, and thereby prevents objectionable oscillations. It should be understood that, of the two shear forces in the pads, i.e., longitudinal and lateral, the longitudinal forces are the more important for stability, and that the plank, by restraining the side frames longitudinally, assures that the longitudinal restraining forces in the pads will be fully effective. It is possible to shape the material in these pads to optimize the stiffness ratio "R" and the overall "Yaw" stiffness, as will be known from my prior disclosures. For many applications, a flat pad will suffice. If a flat pad is chosen, as shown, it should be kept in mind that the bearing adapter will be restrained from roll motion by the axle, but it will be possible for the adapter to pitch relative to the side frame and axle, making the effective longitudinal stiffness lower than the lateral. In general, for freight car truck applications, this is acceptable.

While the bolster 9 has been omitted from FIG. 4, in the interest of clarity of illustration, its position above and in spaced parallelism with the plank 13 is clear from FIGS. 5 and 6. The axles 1, wheels 2 and 3, bearings 4, caps 5, adapters 6, side frames 7 and springs 8, are all similar to the same elements shown in FIGS. 1 to 3, and are characteristic of the truck selected for retrofitting.

If the invention is applied to an existing car, the coupler height will be raised by the thickness of the plank inserted and the thickness of the pads. Couplers are not shown, but it should be understood that the increase in coupler height can be kept to about one-half the pad thickness by using pads under only one end of each side frame, preferably the end nearest the coupler, as taught by the '069 patent. In some cases, the increase in coupler height can be compensated for by removing shims which are frequently provided to offset the loss in free spring height that normally occurs in service.

When this invention is used on new cars, pockets (not shown) for the elastomeric pads are, desirably, cast into the side frames in region B. These pockets would overlie the pads, have the shape thereof, and will increase pad stability. The side frame modifications should also provide increased longitudinal clearances of about one-quarter inch at locations C, D and E. This will increase the curving range. The lateral clearance at C should be increased by about one-eighth inch so that there is no tendency for binding in yaw between the surfaces at C and D. Having the backup for lateral forces in the pads 14 occur at D, rather than C, will aid the dynamic recovery of the truck from major lateral truck deviations.

Because the inserted plank prevents large lateral motion of one axle relative to the other, the brake shoes diagrammatically indicated at 23 can be guided laterally in more precise fashion, relative to the wheel treads, by using centering springs (not shown) in the pockets N (FIG. 4). Any conventional brake equipment can be accommodated.

The plank shown in FIGS. 4 to 6 is inserted in the manner of a spring plank, i.e., with its ends extending under the truck springs. However, the plank need not necessarily be inserted in this manner. It may be terminated short of the springs and fastened to the side frames in some other manner, as by bolting to some lower portions of the side frames. Even where the plank ends extend under the springs, as in FIGS. 4 to 6, it is also contemplated to provide a fastening means for securing the ends of the plank to the side frames. This will assure avoidance of relative yaw motions, for instance, in high-speed operation of a lightly loaded truck. Such a fastening devices may take a variety of forms, for instance, bolts such as indicated at 22 in FIGS. 4 and 6.

For applications where curving is of the utmost importance, the pads can be equipped with a low friction surface, preferably on the top thereof, engaging a smooth metallic surface, preferably stainless steel, attached to the roof of the side frame pedestal opening, at B.

When the arrangement of the invention is to be incorporated in newly manufactured trucks, attachment lugs for the transverse plank may be provided on the side frames, and the ends of the plank would not necessarily be positioned under the springs.

Similarly, in newly manufactured trucks, the side frame dimensions can be adjusted to accommodate the thickness of the pads and the spring planks without increasing the coupler height when new springs are used.

I claim:

1. A vehicle truck assembly, comprising: main truck framing including bolster means extending transversely of the truck for load-bearing association with the axled wheelsets of a wheeled vehicle, and a pair of side frame members each having springs associated with a corresponding end portion of said bolster means to transmit load from the bolster to the associated frame member, and each side frame having means defining a pair of pedestals for load-imposing cooperation with outboard axle portions; roller bearing means for each outboard axle portion, each such roller bearing means being in load-carrying association with a corresponding pedestal; each pedestal having pedestal jaws embracing the associated roller bearing means and the pedestal jaws for the bearings for at least one of the axles having clearance between the pedestal jaws and the associated roller bearing longitudinally of the truck to provide freedom for relative yaw motions of at least one of the truck axles with respect to the side frame members; plank means lying in a substantially horizontal plane and extended transversely of the truck and with opposite end regions of the plank means each extended between the springs and a corresponding side frame member to restrain relative fore-and-aft movement of the side frame members; the plank means being torsionally flexible, thereby providing freedom for relative pitching movement of the side frame members with respect to each other; and yieldable resilient means interposed between the bearing means of at least one axle and its corresponding side frame pedestals, said yieldable means being of stiffness sufficient yieldably to oppose relative yaw motions of the truck axles within said clearance between the pedestal jaws and the roller bearings and thereby yieldingly oppose relative departure of the axles from positions in which the wheelsets are parallel.

2. A vehicle truck assembly, comprising: main truck framing including bolster means extending transversely of the truck for load-bearing association with the axled wheelsets of a wheeled vehicle, and a pair of side frame members each having springs associated with a corresponding end portion of said bolster means to transmit load from the bolster to the associated frame member, and each side frame having means defining a pair of pedestals for load-imposing cooperation with outboard axle portions; roller bearing means for each outboard axle portions, each such roller bearing means being in load-carrying association with a corresponding pedestal; each pedestal having pedestal jaws embracing the associated roller bearing means and the pedestal jaws for the bearings for at least one of the axles having clearance between the pedestal jaws and the associated roller bearing longitudinally of the truck to provide freedom for relative yaw motions of at least one of the truck axles with respect to the side frame members; plank means lying in a substantially horizontal plane and extended transversely of the truck between the side frame members; means at each end of the plank means for rigidly connecting the plank means to the adjacent side frame members and thereby restrain relative fore-and-aft movement of the side frame members; the plank means being torsionally flexible, thereby providing freedom for relative pitching movement of the side frame members with respect to each other; and yieldable resilient means interposed between the bearing means of at least one axle and the corresponding side frame pedestals, said yieldable means being of stiffness sufficient yieldably to oppose relative yaw motions of the truck axles within said clearance between the pedestal jaws and the roller bearings and thereby yieldingly oppose relative departure of the axles from positions in which the wheelsets are parallel.

3. A truck assembly in accordance with claim 2, and in which said yieldable means comprises bodies of elastomeric material interposed between the bearing means and the pedestal members of said one axle.

4. A truck assembly in accordance with claim 2, and in which said plank means includes spaced elongate flanges spanning, and slidable with respect to, those side portions of said bolster means which extend transversely of said truck.

* * * * *